US008919978B2

(12) United States Patent
Lin

(10) Patent No.: US 8,919,978 B2
(45) Date of Patent: Dec. 30, 2014

(54) LIGHTING DEVICE

(71) Applicant: Lextar Electronics Corporation, Hsinchu (TW)

(72) Inventor: Ching-Yao Lin, New Taipei (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 14/056,503

(22) Filed: Oct. 17, 2013

(65) Prior Publication Data

US 2014/0118999 A1 May 1, 2014

(30) Foreign Application Priority Data

Oct. 25, 2012 (TW) ..... 101139488 A

(51) Int. Cl.
*F21V 13/08* (2006.01)
*F21V 13/12* (2006.01)

(52) U.S. Cl.
CPC ..... *F21V 13/08* (2013.01); *F21V 13/12* (2013.01)
USPC ..... 362/84; 362/298; 362/217.05

(58) Field of Classification Search
USPC ..... 362/84, 289, 298, 302, 304, 305, 362/217.05
See application file for complete search history.

(56) References Cited

U.S. PATENT DOCUMENTS

| | | | | |
|---|---|---|---|---|
| 8,465,167 | B2 * | 6/2013 | Maxik et al. | 362/84 |
| 2007/0297179 | A1 * | 12/2007 | Leung et al. | 362/296 |
| 2011/0188228 | A1 * | 8/2011 | Li | 362/84 |
| 2012/0007130 | A1 | 1/2012 | Hoelen et al. | |
| 2013/0063924 | A1 * | 3/2013 | Pickard | 362/84 |
| 2013/0100642 | A1 * | 4/2013 | Zhang | 362/84 |
| 2013/0155648 | A1 * | 6/2013 | Morgenbrod et al. | 362/84 |

* cited by examiner

*Primary Examiner* — Laura Tso
(74) *Attorney, Agent, or Firm* — Moser Taboada

(57) ABSTRACT

A lighting device includes a light bar, two reflective covers and a reflective plate. The two reflective covers respectively connected to two opposite long sides of the light bar. The reflective plate is positioned at the light output side of the light bar. The reflective surface of the reflective plate faces the light output side of the light bar. The reflective plate has a wavelength conversion layer positioned on the reflective surface thereof. The light bar emits a first wavelength light, and a portion of the first wavelength light is converted by the wavelength conversion layer into a second wavelength light which is reflected by the reflective plate to the two reflective covers, while the remaining non-converted first wavelength light is reflected by the reflective plate to the two reflective covers and mixed with the second wavelength lights to give a light with a predetermined spectrum.

12 Claims, 3 Drawing Sheets

LIGHTING DEVICE

RELATED APPLICATIONS

This application claims priority to Taiwan Patent Application No. 101139488, filed Oct. 25, 2012, the entirety of which is herein incorporated by reference.

BACKGROUND

1. Technical Field

The present disclosure relates to a lighting device; more particularly, a lighting device for emitting twice-reflected light.

2. Description of Related Art

Recently, as the energy crisis attracts more and more attention, various innovative energy-saving lighting devices have been developed. Among them, the light-emitting diode (LED) is believed to be the next-generation lighting tool because of its advantageous characteristics of high luminescent efficiency, low power consumption, and mercury-free and long service life.

Regarding white light LED for illuminating purposes, the conventional technology has disclosed various manufacturing processes. Among them, some processes utilize the LED chip together with phosphors; for example, the blue light emitted from the blue-light LED chip excite the yellow phosphors to emit the yellow light, and then the blue and yellow lights are mixed to give the white light.

Common techniques for coating phosphors comprise a remote phosphor technique which coats the phosphor on a diffusion sheet. In comparison with conventional methods in which the phosphors are mixed with the sealant of the LED, the remote phosphor technique may prevent the phosphors from being affected by the heat generated from the irradiation of the LED chip. Moreover, since the service life of the phosphor is shorter than that of the LED chip, once the color temperature of the light changes, the user may simply replace the diffusion sheet and then the LED device can be still used. However, while coating the phosphor onto the diffusion sheet, because the coating area of the phosphor has to equal to the light output area, the usage of phosphor increases substantially. As the phosphors are quite costly, the manufacturing cost of the lighting device also increases.

SUMMARY

The following presents a simplified summary of the disclosure in order to provide a basic understanding to the reader. This summary is not an extensive overview of the disclosure and it does not identify key/critical components of the present invention or delineate the scope of the present invention. Its sole purpose is to present some concepts disclosed herein in a simplified form as a prelude to the more detailed description that is presented later.

In view of the problems faced by the prior art, the present disclosure provides a lighting device that overcomes these problems.

According to one embodiment of the present disclosure, a lighting device comprises a light bar, reflective covers and a reflective plate. The light bar comprises a substrate and a plurality of light-emitting units positioned thereon. The two reflective covers are respectively connected to two opposite long sides of the light bar. The reflective plate is positioned at a light output side of the light bar and spaced therefrom by a distance (H). The reflective surface of the reflective plate faces the light output side of the light bar, and the reflective plate has a wavelength conversion layer positioned on the reflective surface thereof. The light bar emits a first wavelength light, and a portion of the first wavelength light is converted by the wavelength conversion layer of the reflective plate into a second wavelength light which is then reflected by the reflective plate to the two reflective covers, while the remaining portion of the first wavelength light not converted by the wavelength conversion layer is reflected by the reflective plate to the two reflective covers and mixed with the second wavelength light to give a light of a predetermined spectrum.

In one embodiment of the present disclosure, the lighting device further comprises a diffusion sheet positioned on a light output path of the light of the predetermined spectrum, such that the light of the predetermined spectrum is outputted uniformly.

In one embodiment of the present disclosure, the lighting device further comprises a plurality of support members respectively connected to the reflective plate and two reflective covers.

In one embodiment of the present disclosure, the light bar comprises a substrate and a plurality of light-emitting units, wherein the light-emitting units are positioned on the substrate.

In one embodiment of the present disclosure, the reflective surface of the reflective plate has an arc shape, a spherical shape or a parabolic shape.

In one embodiment of the present disclosure, the two reflective covers are symmetrical with each other with respect to the substrate.

In one embodiment of the present disclosure, each of the light-emitting units is a light-emitting diode (LED).

In one embodiment of the present disclosure, the wavelength conversion layer comprises a material of a phosphor, a dye, a pigment, or a combination thereof.

In one embodiment of the present disclosure, the size of the reflective plate and the distance H between the reflective plate and the light bar are configured such that the first wavelength light emitted from the light bar is completely projected to the reflective plate.

In one embodiment of the present disclosure, the area of the wavelength conversion layer is substantially equal to or smaller than the projected area of the reflective plate, wherein the projected area is illuminated by the first wavelength light that is projected from the light bar to the reflective plate.

In one embodiment of the present disclosure, the light bar is vertically projected on a region of the reflective plate, and the region of the reflective plate is substantially equal to a surface area of the wavelength conversion layer.

In one embodiment of the present disclosure, the reflective plate comprises a light-impermissible material.

According to the present disclosure, the reflective plate and light bar of the lighting device are kept distant by a distance (H), and while the light bar outputted the light, the area of the light projected on the reflective plate is smaller than the overall area of the output surface of the lighting device. In this way, while disposing the wavelength-converting materials on the reflective plate, the usage of wavelength-converting materials could be reduced, as compared with conventional coating techniques; also, the wavelength conversion layer does not in direct contact with the light bar, thereby avoiding the damage problems associated with the high temperature caused by the light emitted from the light bar, which in turn prolongs the service life of the wavelength conversion layer. Additionally, when it is desirable to change the color temperature of the lighting device, the user may simply replace the wavelength conversion layer to change the color temperature of the outputted light, thereby facilitating the process of changing the color temperature of the lighting device.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawing, wherein.

DETAILED DESCRIPTION

Figure 1:
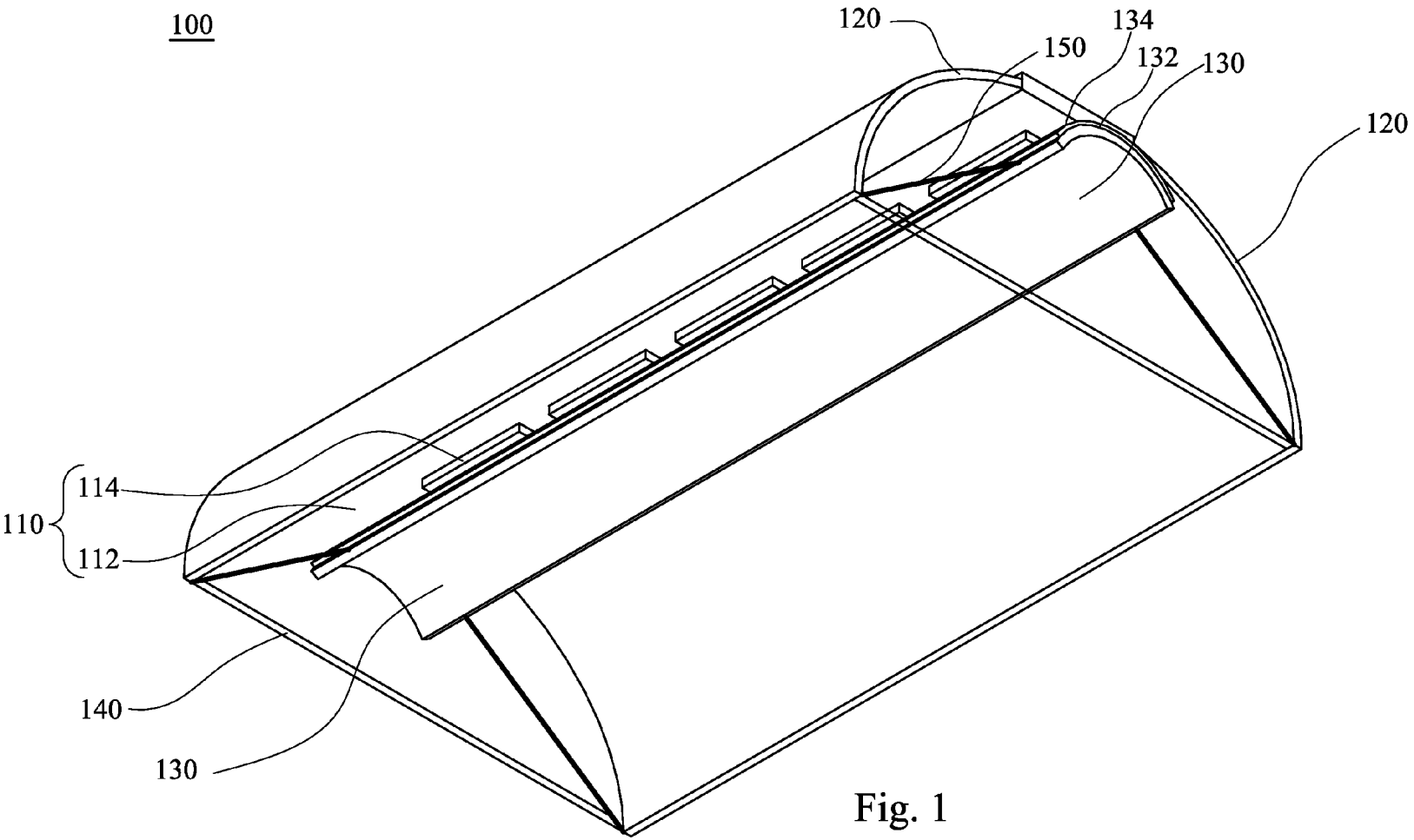
FIG. 1 is pictorial drawing illustrating a lighting device according to one embodiment of the present disclosure.

In the following detailed description, for purposes of explanation, numerous specific details are set forth in order to attain a thorough understanding of the disclosed embodiments. In accordance with common practice, the various described features/elements are not drawn to scale but instead are drawn to best illustrate specific features/elements relevant to the present invention. Also, like reference numerals and designations in the various drawings are used to indicate like elements/parts. Moreover, well-known structures and devices are schematically shown in order to simplify the drawing and to avoid unnecessary limitation to the claimed invention.

Figure 2:
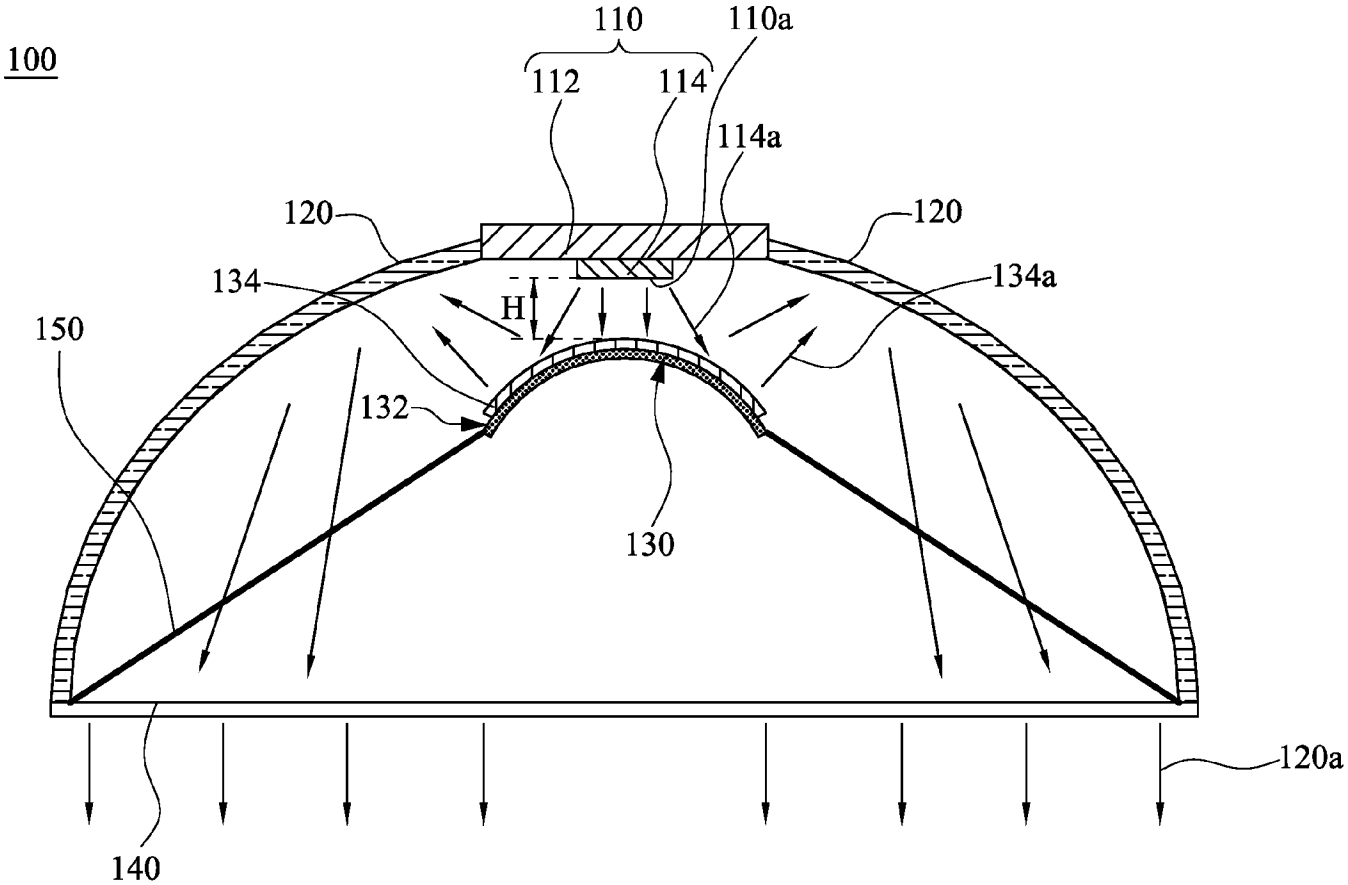
FIG. 2 is a main view drawing illustrating the lighting device according to FIG. 1.

Please refer to FIGS. 1 and 2, in which FIG. 1 is pictorial drawing illustrating a lighting device 100 according to one embodiment of the present disclosure; while FIG. 2 is a main view drawing illustrating the lighting device 100 according FIG. 1.

In the present embodiment, the lighting device 100 comprises a light bar 110, reflective covers 120 and a reflective plate 130. The light bar 110 comprises a substrate 112 and a plurality of light-emitting units 114 positioned on the substrate 112. The circuit positioned on the substrate 112 is used to connect to an external power source for supplying electricity to the light-emitting units 114 such that they emit light. In the present embodiment, each of the light-emitting units 114 is a light-emitting diode, or a light-emitting diode packaged with a transparent sealant; however, the present invention is not limited thereto. The two reflective covers 120 are respectively connected to two opposite long sides of the light bar 110; the reflective surfaces of the two reflective covers 120 face the light bar 110 such that they are configured to reflect the light For example, after the two reflective covers 120 are connected to the light bar 110, the surface facing the light bar 110 is positioned with a layer of light-reflective layer thereon or coated with a light-reflective material so as to form a reflective surface, such that after the light is emitted to the reflective surfaces of the reflective covers 120, the direction of the light path is changed because of the reflection, and the reflected light is outputted along a specific path. The two reflective covers 120 are respectively connected to two opposite long sides of the light bar 110; additionally, the two reflective covers 120 are symmetrical with each other with respect to the substrate 112 of the light bar 110; however, the present invention is not limited thereto. In the present embodiment, the reflective surfaces of the reflective covers 120 may have an arc shape, a spherical shape or a parabolic shape, or a combination thereof; however, in other embodiments, it is not limited to the above-mentioned shapes.

The reflective plate 130 is positioned at the light output side of the light bar 110 and spaced from the light bar 110 by a distance (H). The reflective surface 132 of the reflective plate 130 faces the light output side of the light bar 110 for reflecting the light emitted from the light bar 110. Due to the configuration of the size of the reflective plate 130 and the distance H between the reflective plate 130 and the light bar 110, light emitted from the light bar 110 is completely projected to the reflective plate 130. In the present embodiment, the reflective surface 132 of the reflective plate 130 has an arc shape, a spherical shape or a parabolic shape; however, in other embodiments, it is not limited to the above-mentioned shapes. For example, when the reflective surface 132 of the reflective plate 130 has an arc shape, the reflective surface 132 may be a convex arc facing the light bar 110, such that after the light from the light bar 110 are emitted to the reflective surface 132, the light is reflected onto the reflective covers 120; however, the present invention is not limited thereto.

Additionally, the reflective plate 130 has a wavelength conversion layer 134 positioned on the reflective surface 132 thereof, in which the wavelength conversion layer 134 is configured to change the wavelength of the light emitted by the light bar 110. It should be noted that the wavelength conversion layer 134 could be partially or completely coated on the reflective surface 132. After the reflective plate 130 reflects the light emitted by the light bar 110, the two reflective covers 120 are used to further reflect the light reflected by the reflective plate 130 to a predetermined light output path of the lighting device 100. In the present embodiment, the wavelength conversion layer 134 comprises a material of a phosphor, dye or pigment, or a combination thereof. In other words, the wavelength conversion layer 134 is formed by coating a layer of a phosphor, dye or pigment, or a combination thereof on the reflective surface 132 of the reflective plate 130. It should be noted that the above-mentioned materials comprised in the wavelength conversion layer 134 are provided for the purpose of illustration, and they are not intended to limit the present disclosure, and persons having ordinary skill in the art which the present disclosure pertains to, may flexibly select suitable materials for forming the wavelength conversion layer 134 depending on actual need(s).

In the present embodiment, the lighting device 100 comprises a diffusion sheet 140, wherein the diffusion sheet 140 is positioned on the light output path of the light reflected by the reflective covers 120, such that the light reflected by the reflective covers 120 is outputted uniformly. For example, two ends of the diffusion sheet 140 are respectively connected to the end portions of the two reflective covers 120 wherein said end portions are not connected to the substrate 112, so that the light reflected by the reflective covers 120 is output uniformly after passing through the diffusion sheet 140; however, the arrangement of the diffusion sheet 140 is not limited thereto. It should be noted that the term "diffusion sheet," as used herein is formed by adding a plurality of light-scattering particles in a light-permissible sheet constituting the diffusion sheet 140. Due to the presence of the light-scattering particles in the body of the light-permissible sheet, the light, while passing through the diffusion layer formed by the light-scattering particles, will continuously pass through two matrices (the light-scattering particles and the light-permissible sheet) with different refractive indexes, such that when the outputted light passes through the diffusion sheet 140, it simultaneously undergoes various refraction, reflection, and scattering phenomenon, thereby achieving the effect of optical scattering, which results in a more uniform light outputted by the diffusion sheet 140.

Moreover, the lighting device 100 comprises a plurality of support members 150 respectively connected to reflective plate 130 and two reflective covers 120, such that the reflective plate 130 and the light bar 110 are configured to maintain a fixed spatial arrangement relationship; however, the present invention is not limited thereto. Since the fixed spatial arrangement relationship between the reflective plate 130 and the light bar 110 is maintained by the support members 150, the light emitted from the light bar 110 may be completely projected onto the reflective surface 132 of the reflective plate 130. In other embodiments, the reflective plate 130 may maintain the fixed spatial arrangement relationship with the light bar 110 via other suitable means.

When the light-emitting units 114 are electrified via the substrate 112, the light bar 110 emits a first wavelength light 114*a*. In the present embodiment, due to the configuration of the size of the reflective plate 130 and the distance H between the reflective plate 130 and the light bar 110, the first wavelength light 114*a* emitted from the light bar 110 is completely projected onto the reflective plate 130; however, the present disclosure is not limited thereto. In the present embodiment, the light bar 110 is vertically projected on a region of the reflective plate 130, and the region of the reflective plate 130 is substantially equal to a surface area of the wavelength conversion layer 134; however, the present invention is not limited thereto. When the first wavelength light 114*a* emitted from the light bar 110 is projected onto the reflective surface 132 of the reflective plate 130, a portion of the first wavelength light 114*a* is converted by the wavelength conversion layer 134 on the reflective surface 132 into second wavelength light 134*a*, which is further reflected to the two reflective covers 120 by the reflective plate 130.

However, the remaining portion of the first wavelength light 114*a* that is not converted by the wavelength conversion layer 134 is simultaneously reflected to the two reflective covers 120 by the reflective plate 130, which is further mixed with the second wavelength light 134*a* to give a light 120*a* of a predetermined spectrum. The light 120*a* of the predetermined spectrum 1 is further output through the diffusion sheet 140 positioned at the light output path of the light 120*a* of the predetermined spectrum 120*a*, so that the light 120*a* of the predetermined spectrum 120*a* can be outputted uniformly.

For example, when the light bar 110 is a light bar 110 capable of emitting the first wavelength light 114*a* of blue, the combination with a wavelength conversion layer 134 for emitting the second wavelength light 134*a* of yellow, would give a light 120*a* of the predetermined spectrum 120*a* having a color temperature of about 5000K, and such light 120*a* of the predetermined spectrum 120*a* is the white light. The light bar 110 for emitting the first wavelength light 114*a* of blue, when combined with a wavelength conversion layer 134 for emitting the second wavelength light 134*a* of red and green, will give a light 120*a* of the predetermined spectrum 120*a* having a color temperature of about 2700K-6500K; said light 120*a* of the predetermined spectrum 120*a* is a white light. The light bar 110 for emitting the first wavelength light 114*a* of blue, when combined with a wavelength conversion layer 134 for emitting the second wavelength light 134*a* of yellow red, will give a light 120*a* of the predetermined spectrum 120*a* having a color temperature slightly lowered than 5000K.

Moreover, the light bar 110 for emitting the blue light can be substituted with a light bar 110 for emitting ultraviolet light. The light bar 110 for emitting the first wavelength light 114*a* of ultraviolet, when combined with a wavelength conversion layer 134 for emitting the second wavelength light 134*a* of yellow, will give a light 120*a* of the predetermined spectrum 120*a* which is yellow. The light bar 110 for emitting the first wavelength light 114*a* of ultraviolet, when combined with a wavelength conversion layer 134 for emitting the second wavelength light 134*a* of yellow red, will give a light 120*a* of the predetermined spectrum 120*a* which is yellow red.

However, the above-described combinations of the light bar 110 and wavelength conversion layer 134 are only provided as examples, and the present disclosure is not limited thereto. It is feasible to combine the light bars 110 of various colors with wavelength conversion layers 134 of various compositions to allow the lighting device 100 to mix light of desired colors and color temperatures, thereby achieving the goal of altering the color and color temperature of the light.

Figure 3:
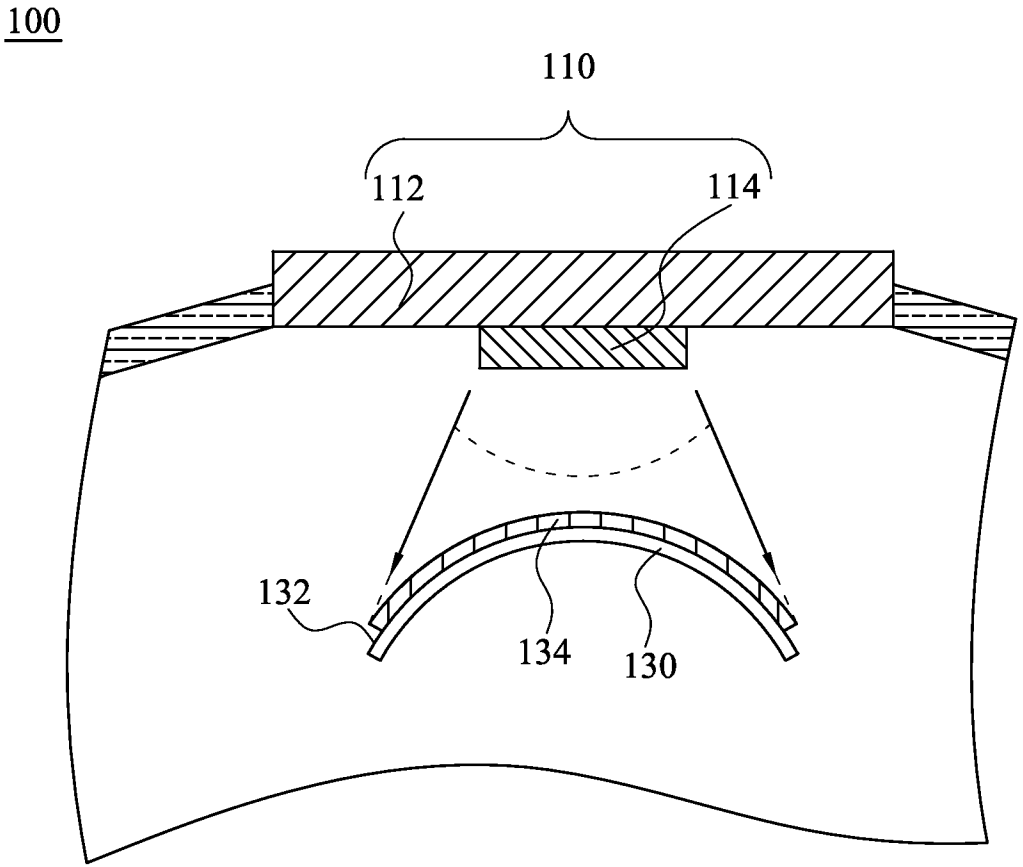
FIG. 3 is partial enlarged drawing illustrating a lighting device according to another embodiment of the present disclosure.

Please refer to FIG. 3 that is partial enlarged drawing illustrating a lighting device 100 according to another embodiment of the present disclosure. In the present embodiment, an area of the wavelength conversion layer 134 is substantially equal to or smaller than a projected area of the reflective plate 130, wherein the projected area is illuminated by the first wavelength light 114*a* that is projected from the light bar 110 to the reflective plate 130; however, the present invention is not limited thereto. In other words, when the first wavelength light 114*a* emitted from the light bar 110 emits is projected on the reflective surface 132 of the reflective plate 130, the first wavelength light 114*a* can be completely projected on the wavelength conversion layer 134 on the reflective surface 132, thereby allowing the wavelength conversion layer 134 to converted into the second wavelength light 134*a*.

In view of the foregoing embodiments of the present disclosure, the application of the present disclosure has the advantages as follows.

According to the present disclosure, the reflective plate and the light bar of the lighting device are kept by a distance H, and the projected area of the light outputted from the light bar on the reflective plate is smaller than the overall light output surface of the lighting device. Accordingly, when disposing the wavelength-converting material on the reflective plate, the usage of the wavelength-converting material is less than that required by the conventional technique which coats the wavelength-converting material on the diffusion sheet.

According to the present disclosure, the wavelength conversion layer of the lighting device is not indirect contact with the light bar, which avoids the damage associated with the high temperature resulted from the light irradiation of the light bar, thereby prolonging the service life of the wavelength conversion layer.

According to the present disclosure, when the user desires to change the color temperature of the light outputted by the lighting device, he/she simply needs to substitute the wavelength conversion layer to change the color temperature of the outputted light, which is more convenient for altering the color temperature of the lighting device.

Although various embodiments of the invention have been described above with a certain degree of particularity, or with reference to one or more individual embodiments, they are not limiting to the scope of the present disclosure. Those with ordinary skill in the art could make numerous alterations to the disclosed embodiments without departing from the spirit or scope of this invention. Accordingly, the protection scope of the present disclosure shall be defined by the accompany claims.

What is claimed is:

1. A lighting device, comprising:

a light bar;

two reflective covers, respectively connected to two opposite long sides of the light bar; and a reflective plate, positioned at a light output side of the light bar and spaced therefrom by a distance (H), wherein a reflective surface of the reflective plate faces the light output side of the light bar, and the reflective plate has a wavelength conversion layer positioned on the reflective surface thereof; the light bar emits a first wavelength light, and a portion of the first wavelength light is converted by the wavelength conversion layer of the reflective plate into a second wavelength light which is then reflected by the reflective plate to the two reflective covers, while the remaining portion of the first wavelength light not converted by the wavelength conversion layer is reflected by the reflective plate to the two reflective covers and mixed with the second wavelength light to give a light of a predetermined spectrum.

2. The lighting device according to the claim 1, further comprising a diffusion sheet, positioned on a light output path of the light of the predetermined spectrum, such that the light of the predetermined spectrum is outputted uniformly.

3. The lighting device according to the claim 1, further comprising a plurality of support members, respectively connected to the reflective plate and the two reflective covers.

4. The lighting device according to the claim 1, wherein the light bar comprises a substrate and a plurality of light-emitting units positioned on the substrate.

5. The lighting device according to the claim 1, wherein the reflective surface of the reflective plate has an arc shape, a spherical shape or a parabolic shape.

6. The lighting device according to the claim 4, wherein the two reflective covers are symmetrical with each other with respect to the substrate.

7. The lighting device according to the claim 4, wherein each of the light-emitting units is a light-emitting diode.

8. The lighting device according to the claim 1, wherein the wavelength conversion layer comprises a material of a phosphor, a dye, a pigment, or a combination thereof.

9. The lighting device according to the claim 1, wherein the size of the reflective plate and the distance (H) between the reflective plate and the light bar are configured such that the first wavelength light emitted from the light bar is completely projected to the reflective plate.

10. The lighting device according to the claim 9, wherein an area of the wavelength conversion layer is substantially equal to or smaller than a projected area of the reflective plate, wherein the projected area is illuminated by the first wavelength light that is projected from the light bar to the reflective plate.

11. The lighting device according to the claim 9, wherein the light bar is vertically projected on a region of the reflective plate, and the region of the reflective plate is substantially equal to a surface area of the wavelength conversion layer.

12. The lighting device according to the claim 1, wherein the reflective plate comprises a light-impermissible material.

* * * * *